US006848509B2

(12) United States Patent
Myerley

(10) Patent No.: US 6,848,509 B2
(45) Date of Patent: Feb. 1, 2005

(54) PRESSURE EQUALIZING PLUNGER VALVE FOR DOWNHOLE USE

(75) Inventor: Thomas S. Myerley, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/254,900

(22) Filed: Sep. 25, 2002

(65) Prior Publication Data

US 2003/0089500 A1 May 15, 2003

Related U.S. Application Data

(60) Provisional application No. 60/345,350, filed on Oct. 22, 2001.

(51) Int. Cl.[7] ..... E21B 34/12

(52) U.S. Cl. ..... 166/332.7; 166/332.8; 166/324

(58) Field of Search ..... 166/320, 324, 166/332.1, 332.7, 332.8

(56) References Cited

U.S. PATENT DOCUMENTS

| | | | | |
|---|---|---|---|---|
| 3,788,595 A | | 1/1974 | Colonna | |
| 3,875,684 A | * | 4/1975 | Henneman | 34/218 |
| 4,207,084 A | * | 6/1980 | Gardner | 96/113 |
| 4,401,063 A | * | 8/1983 | Haase | 123/73 B |
| 4,411,316 A | * | 10/1983 | Carmody | 166/323 |
| 4,415,036 A | | 11/1983 | Carmody et al. | |
| 4,475,599 A | | 10/1984 | Akkerman | |
| 4,478,286 A | | 10/1984 | Fineberg | |
| 5,127,807 A | * | 7/1992 | Eslinger | 417/360 |
| 6,079,497 A | | 6/2000 | Johnston et al. | |
| 6,283,217 B1 | | 9/2001 | Deaton | |
| 6,296,061 B1 | | 10/2001 | Leismer | |

FOREIGN PATENT DOCUMENTS

WO WO 98/57029 12/1998

OTHER PUBLICATIONS

Sides, et al., "Controlling Self–Equalizing Velocity Extends Valve Life," Petreleum Engineer International, 64(1992), 2 pages.

* cited by examiner

*Primary Examiner*—David Bagnell
*Assistant Examiner*—Shane Bomar
(74) *Attorney, Agent, or Firm*—Steve Rosenblatt

(57) ABSTRACT

An equalizer valve for a flapper in an SSV has one embodiment where the plunger body is covered with a lubricious material in the bore in the flapper to counteract wear caused by off-center contact with the plunger by the flow tube. In another embodiment the flow tube and the plunger have matching angled surfaces to reduce the resultant moment of the plunger from offset contact of the flow tube. In another embodiment the flow tube contacts the plunger on center to eliminate a resultant moment, which can cause wear in the flapper bore or to the plunger.

20 Claims, 2 Drawing Sheets

PRESSURE EQUALIZING PLUNGER VALVE FOR DOWNHOLE USE

This application claims the benefit of U.S. Provisional Application No. 60/345,350 on Oct. 22, 2001.

FIELD OF THE INVENTION

The field of the invention is downhole valves and, more particularly, plunger type equalizer valves mounted to flappers in downhole safety valves.

BACKGROUND OF THE INVENTION

Wells typically contain sub-surface safety valves (SSV), which are actuated from the surface through a control line, which runs down to the valve. These valves have a biased closure member, known as a flapper. The flapper is biased into contact with a mating seat for isolation of a zone in the well from the surface. The flapper is positioned perpendicularly to the longitudinal axis of the wellbore, when it is in the closed position. To open the valve, pressure through the control line causes a flow tube to shift against a bias force. The flow tube engages the flapper to rotate it 90 degrees. The flow tube continues to advance as the flapper is positioned behind it.

In certain wells, with the SSV closed and formation pressure acting on the flapper in the closed position, it is desirable to equalize the pressure on both sides of the flapper before attempting to rotate it with the flow tube. A pressure imbalance can occur because there is gas at low pressure above the flapper and high pressure from the formation below the flapper. One costly way to equalize the pressure is to add heavy fluid above the flapper. An easier way is to install and equalizing valve in the flapper so that when the flow tube starts moving down it strikes the plunger of the equalizing valve first. This causes the plunger to move to equalize the pressure across the flapper before the flapper is pushed away from its seat by the flow tube. A few examples of this design are U.S. Pat. Nos. 4,475,599 and 4,478,286.

The layout of the principal components of an SSV in the closed position is illustrated in FIG. 1. The SSV 10 has a body 12 and a flapper 14 pinned at pin 16 to body 12. The flapper 14 is biased to the closed position shown by a spring 18. Flapper 14 is in contact with a seat 20, in the closed position shown in FIG. 1. A flow tube 22 is driven by pressure in a control line (not shown) against the force of a spring 24. The equalizer valve 26 is disposed in the flapper 14 so that upon initial downward movement of the flow tube 22, the initial contact occurs between the equalizer valve 26 and the flow tube 22, which results in pressure equalization before the flow tube 22 pushes the flapper 14 off of seat 20. When the flow tube 22 moves down completely, as shown in FIG. 2, the flapper 14 is behind the flow tube 22. FIG. 2 also illustrates the initial position of equalizer valve 26 when the flapper 14 is in the closed position of FIG. 1. It can be seen that the equalizer valve is engaged off-center by the flow tube 22. One reason for this offset contact is the limited choice of placement of the equalizer valve 26. FIG. 3 shows a view of the underside of the flapper 14 showing the bore 28 located in the thick segment 30 of flapper 14. In order to get a sufficiently long bore, it was located in the remotest part of the thick segment 30. FIG. 6 illustrates the need for offset contact. The equalizer valve 26 comprises a plunger 32 and a bore 34 that extends from the upper end 36 to lateral bores 38. When depressed by the flow tube 22 the lateral bores 38 extend below the lower end 40 of the flapper 14 and equalizing flow is established. The offset contact is used in this design to avoid obstructing the bore 34 during initial movement of the plunger 32. FIG. 2 illustrates another aspect of the prior design. The plunger 32 had a chamfer 42 so as to avoid contact with the flow tube 22 when the SSV was in the open position. This need for clearance made the end of the plunger 32 asymmetrical, making the installed orientation critical to achieve the desired clearance with the flow tube 22 when the SSV was opened.

The offset contact between the flow tube 22 and the plunger 32 tended to put a counterclockwise moment on the plunger 32 and resulted in abnormal wear on portion 44, closest to the point of offset contact. To combat this problem of wear, the plunger 32 was first produced and measured. Thereafter, bore 28 was machined to about 0.001 inch over the diameter of the plunger 32 and both surfaces were polished to 8 RMS. The problem was that each plunger 32 was custom fit to each bore 28 so that it was not possible to maintain a store of spare parts that could be counted on to provide adequate service. Even with expensive machining, the problem of premature wear due to offset contact, created a reliability and maintenance concern. Accordingly, the objective of the present invention is to provide design features to minimize or otherwise cope with the wear issue from offset contact. Another feature of the invention is to work around offset contact that caused the wear and still allow the equalizer valve 26 to effectively function. Those skilled in the art will appreciate how the invention addresses these objectives from a review of the detailed description of the preferred embodiment, which appears below.

SUMMARY OF THE INVENTION

An equalizer valve for a flapper in an SSV is disclosed. In one embodiment the plunger body is covered with a lubricious material in the bore in the flapper to counteract wear caused by off-center contact with the plunger by the flow tube. In another embodiment the flow tube and the plunger have matching angled surfaces to reduce the resultant moment of the plunger from offset contact of the flow tube. In another embodiment the flow tube contacts the plunger on center to eliminate a resultant moment, which can cause wear in the flapper bore or to the plunger.

DETAILED DESCRIPTION OF THE PREFERRED EMBODIMENT

Figure 4A:
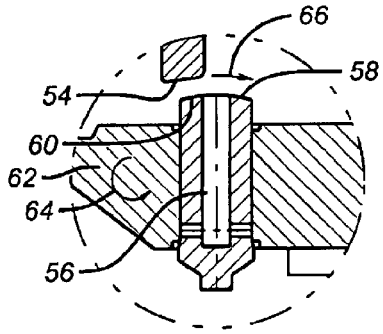
FIGS. 4*a* and 4*b* show alternative designs of the plunger in section.
Figure 4B:
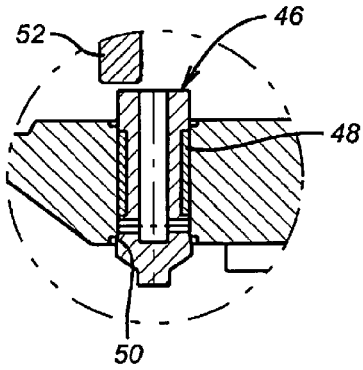

FIG. 4 illustrates two solutions to the problem of excessive wear on the plunger 46. A bearing 48, which can be in one or more pieces, can be mounted over the plunger 46 in bore 50. The bearing material is preferably PEEK or graphite filled Teflon. Using this solution, the flow tube 52 still hits the plunger 46 off center but the resultant moment does not result in wear of the plunger 46 or the bore 50. This is because the lubricious nature of the bearing 48. The clearance between the bearing 48, the plunger 46, and the bore 50 can be increased to greater than the about 0.001 inch clearance used with the prior technique where the bore 28 was machined after measuring the plunger 32. The polishing that was done in the past could also be minimized through the use of a bearing such as 48. Other materials could be used for the bearing 48, with those having lubricious qualities being preferred. Clearly the choice of materials must take into account the surrounding well conditions such as temperature and compatibility with the surrounding well fluids. The bearing 48 may be in two or more pieces longitudinally split to cover for 360 degrees around the plunger 46.

Figure 1:
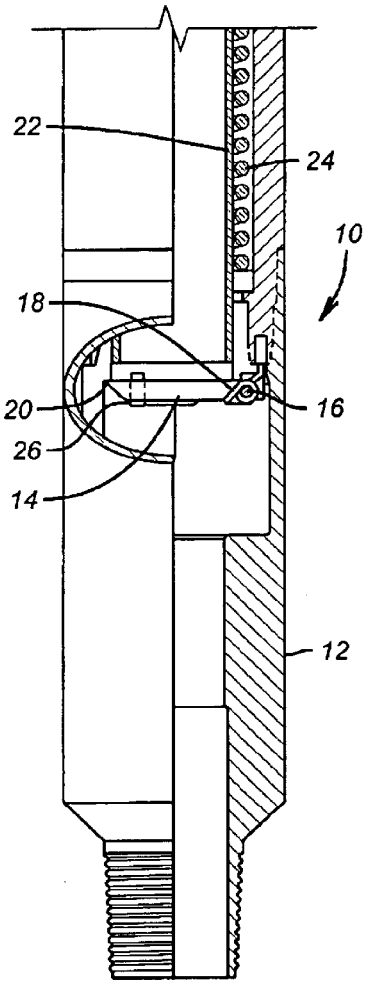
(PRIOR ART) FIG. 1
FIG. 1 is an elevation, in section, of an SSV of the prior art in the closed position.
Figure 2:
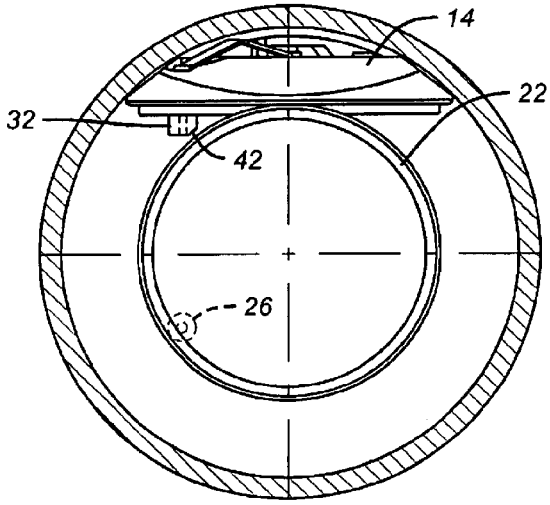
(PRIOR ART) FIG. 2
FIG. 2 is a section view through the SSV of FIG. 1 looking up when the SSV is in the open position.
Figure 3:
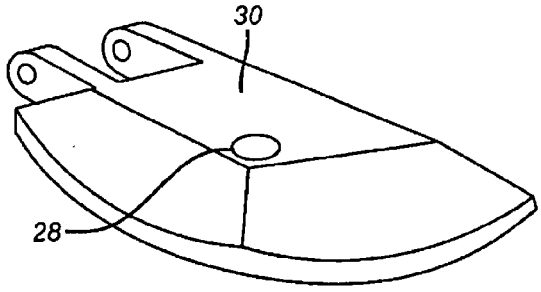
(PRIOR ART) FIG. 3
FIG. 3 is a view of the downhole side of the flapper shown in FIG. 1, showing the location of the bore for the equalizer valve plunger.
Figure 6:
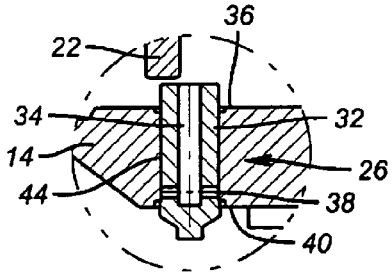
(PRIOR ART) FIG. 6
FIG. 6 is a section view, in elevation of a prior art design showing the offset contact.

Separately from or in addition to using the bearing 48, the flow tube 52 can have an angled cut 54 in the range of about 10 degrees or less. The plunger 46 about bore 56 can have a slant cut 58, preferably matching the angled cut 54 on the flow tube 52. By disposing the slant cut 58 about the bore 56, the upper end 60 is symmetrical at the periphery making its orientation irrelevant when it is being installed. The slant cut 58 also alleviates the clearance issue with the flow tube 52, when the flapper 62 is pushed to the open position. Previously, as illustrated in FIG. 2 there was a chamfer 42, which had to be oriented in a specific orientation to provide clearance to the flow tube 22 in the open position shown. Now, as shown in FIG. 4 there are no longer any orientation concerns as the upper end 60 is preferably symmetrical at its periphery. The presence of the slant cut 58 coupled with the symmetry allows for the clearance such as shown in FIG. 2 to be available without regard to the installed orientation of the plunger 46. Moreover, by providing the slant cut 58 around the bore 56, the counterclockwise moment, represented by arrow 64, created by the offset contact between the plunger 46 and the flow tube 52 can be minimized. This is because a horizontal force component, represented by arrow 66, is created by the contact of slant cut 58 and angled cut 54. The greater the angle, the larger the horizontal force component 66. There are limits to this angle, for if it were made too great, the wear problem would simply shift sides from the prior design depicted in FIG. 6. However, combining the use of a bearing 48 would allow for a wider mating angle range to as much as about 25–30 degrees on the flow tube 52 and the plunger 46.

Figure 5A:
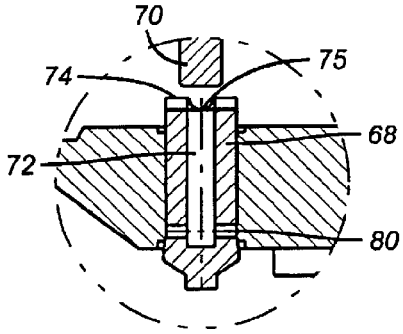
FIG. 5*a* is an alternate design to FIG. 5 showing a top notch on the plunger.
Figure 5:
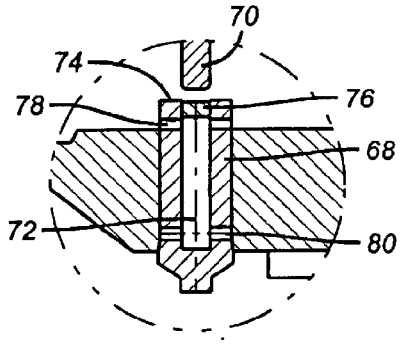
FIG. 5 shows the embodiment of the flow tube engaging the plunger on or close to center.

Referring now to FIG. 5, another option, which can be used alone or with one or both options described in FIG. 4, is illustrated. Here the plunger 68 is contacted on or close to center by the flow tube 70. The bore 72 may be closed off at the upper end 74 by a plug 76 or simply left open for the flow tube 70 to obstruct. Lateral passages 78 allow flow entering bore 72 from lateral passages 80 to exit, upon displacement of plunger 68 by flow tube 70. With the contact being on or near center, the moment created by off center contact is reduced, if not eliminated. By combining the other features, shown in FIG. 4, the same result can be obtained with a more off-center contact in the manner previously described. The lateral passages 78 allow for on center contact by the flow tube 70, without obstructing the equalizing flow. Another alternative to this method is to slot 75 the upper end 74 of the plunger 68 (see FIG. 5*a*). This relieves the possibility of obstructing the lateral passages 78 (see FIG. 5) with the bore 72.

Those skilled in the art will appreciate the in the embodiments illustrated the plunger is biased to a position that will preclude an equalizing flow through it until it is displaced by the flow tube, prior to the flow tube contacting the flapper for its 90 degree rotational movement. The plunger is slidably retained in the flapper against falling out. These known features have not been discussed in detail as they are familiar to those skilled in the art and are not the focus of the present invention.

While the preferred embodiment has been described above, those skilled in the art will appreciate that other mechanisms are contemplated to accomplish the task of this invention, whose scope is delimited by the claims appended below, properly interpreted for their literal and equivalent scope.

I claim:

1. A downhole safety valve, comprising:

a body;

a flapper and a conforming seat in said body, said flapper pivotally mounted between a closed position against said seat and an open position away from said seat;

a flow tube, movable in an axial direction and selectively engageable to said flapper to urge it to its said open position;

a plunger having a longitudinal central axis in a straight bore through said flapper, said flow tube initially contacting said plunger in general axial alignment with its central longitudinal axis for pressure equalization through said flapper exclusively through said bore.

2. The valve of claim 1, further comprising:

a bearing in said bore to contact said plunger to facilitate its reciprocal movement in said bore.

3. The valve of claim 2, wherein:

the clearance between said plunger and said bore exceeds 0.001 inches.

4. A downhole safety valve, comprising:

a body;

a flapper and a conforming seat in said body, said flapper pivotally mounted between a closed position against said seat and an open position away from said seat;

a flow tube, movable in an axial direction and selectively engageable to said flapper to urge it to its said open position;

a plunger having a longitudinal central axis in a straight bore through said flapper, said flow tube initially contacting said plunger in general axial alignment with its central longitudinal axis for pressure equalization through said flapper through said bore;

said plunger comprises a flowpath therethrough, said flowpath being obstructed until said flow tube displaces said plunger.

5. The valve of claim 4, wherein:

a portion of said flowpath runs along said longitudinal axis of said plunger.

6. The valve of claim 5, wherein:

said flowpath comprises at least one first lateral passage closed off by said flapper until said plunger is moved by said flow tube.

7. The valve of claim 6, wherein:

said plunger comprises a closed upper end where said flow tube contacts it and at least one second lateral passage to allow equalizing flow from said first lateral passage to flow out from said bore in said flapper.

8. The valve of claim 6, wherein:

said plunger comprises at least one groove where said flow tube contacts it to act as a second lateral passage to allow equalizing flow from said first lateral passage to flow out from said bore in said flapper.

9. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger having a longitudinal axis in a straight bore through said flapper, said flow tube initially contacting said plunger in general alignment with its longitudinal axis for pressure equalization through said flapper through said bore;

a bearing in said bore to contact said plunger to facilitate its reciprocal movement in said bore;

said bearing is longitudinally split.

10. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis for pressure equalization through said flapper exclusively through said bore, said bore further comprising a bearing in contact with said plunger.

11. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis, said bore further comprising a bearing in contact with said plunger;

said plunger comprises a top end bevel sloped symmetrically about said longitudinal axis.

12. The valve of claim 11, wherein:

said beveled end of said plunger is out of contact with said flow tube after said flow tube pushes said flapper to said open position, regardless of the orientation of said plunger about its longitudinal axis.

13. The valve of claim 11, wherein:

said flow tube comprises a lower beveled end having a slope substantially equal to said top beveled end of said plunger.

14. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis, said bore further comprises a bearing in contact with said plunger;

said plunger comprises a top end bevel sloped symmetrically about said longitudinal axis;

said plunger comprises a passage therethrough having an upper exit aligned with said longitudinal axis.

15. The valve of claim 14, wherein:

said flow tube contacts said plunger in a manner that does not fully obstruct said exit.

16. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis, said bore further comprises a bearing in contact with said plunger;

said plunger comprises a top end bevel sloped symmetrically about said longitudinal axis;

said flow tube comprises a lower beveled end having a slope substantially equal to said top beveled end of said plunger;

said slopes on said flow tube and said plunger are up to about 30 degrees measured from said longitudinal axis of said plunger.

17. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis, said plunger comprises a top end bevel sloped symmetrically about said longitudinal axis, said bevel contacted by a substantially mating bevel on said flow tube, said plunger when displaced by said flow tube directly equalizing pressure across said flapper before said flapper moves off said seat.

18. The valve of claim 17, wherein:

said beveled end of said plunger is out of contact with said flow tube after said flow tube pushes said flapper to said open position, regardless of the orientation of said plunger about its longitudinal axis.

19. The valve of claim 17, wherein:

said flow tube comprises a lower beveled end having a slope substantially equal to said top beveled end of said plunger.

20. A downhole safety valve, comprising:

a body;

a flapper and a conforming seat in said body, said flapper pivotally mounted between a closed position against said seat and an open position away from said seat;

a flow tube selectively engageable to said flapper to urge it to its said open position;

a plunger extending from a bore in said flapper for initial contact by said flow tube and having a longitudinal axis; said plunger comprises a top end bevel sloped symmetrically about said longitudinal axis;

said plunger comprises a passage therethrough having an upper exit aligned with said longitudinal axis;

said flow tube contacts said plunger in a manner that does not fully obstruct said exit.

* * * * *